United States Patent [19]

Genev

[11] Patent Number: 4,721,260

[45] Date of Patent: Jan. 26, 1988

[54] DISC CRUSHER

[75] Inventor: Ivan V. Genev, Sofia, Bulgaria

[73] Assignee: N I I Po Cherna Metalurgia, Sofia, Bulgaria

[21] Appl. No.: 888,532

[22] Filed: Jul. 21, 1986

[30] Foreign Application Priority Data

Jul. 19, 1985 [BG] Bulgaria ..... 71152

[51] Int. Cl.[4] ..... B02C 7/14

[52] U.S. Cl. ..... 241/101.2; 241/252; 241/259; 241/259.3; 241/286

[58] Field of Search ..... 241/101.2, 234, 252, 241/259, 259.1, 259.2, 259.3, 285 A, 286, 290

[56] References Cited

U.S. PATENT DOCUMENTS

| | | | |
|---|---|---|---|
| 1,034,034 | 7/1912 | Rozelle | 241/286 X |
| 1,864,575 | 6/1932 | Ball | 241/286 |
| 2,455,565 | 12/1948 | Davis | 241/259 X |
| 2,597,548 | 5/1952 | Traylor, Jr. | 241/286 |
| 2,838,247 | 6/1958 | Hauser | 241/259 X |
| 2,972,448 | 2/1961 | Dorsey | 241/286 |
| 3,103,316 | 9/1963 | Schaal | 241/259 X |
| 3,142,449 | 7/1964 | Balmer | 241/286 |
| 3,420,457 | 1/1969 | Peters et al. | 241/286 X |
| 4,199,113 | 4/1980 | Genev | 241/252 X |

*Primary Examiner*—Howard N. Goldberg
*Assistant Examiner*—Joseph M. Gorski

[57] ABSTRACT

A disc crusher has a base frame on which a case with cover is mounted. A bottom disc seated in a bearing housing is fastened to the cover of the case. A cone is mounted in a bearing body fastened to the cover by shock absorbing springs. The bottom disc and cone each have a central hole. In one embodiment, the bearing housing is connected by a flange, stud bolts and springs to a top ring with flange and a bottom ring with flange, also fastened by means of stud bolts to the cover of the case, which rings have external threads formed with opposite pitch directions and are embraced externally by a regulating sleeve (nut) on the internal cylindrical surface of which there are threaded zones which correspond to the threads of the top and bottom rings. The regulating sleeve (nut) is provided on the outside with a guiding disc connected to a driving mechanism and an arresting mechanism.

9 Claims, 4 Drawing Figures

FIG. 3
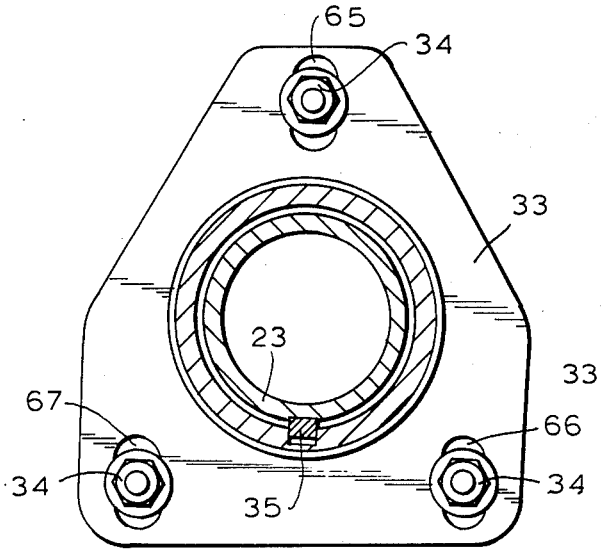
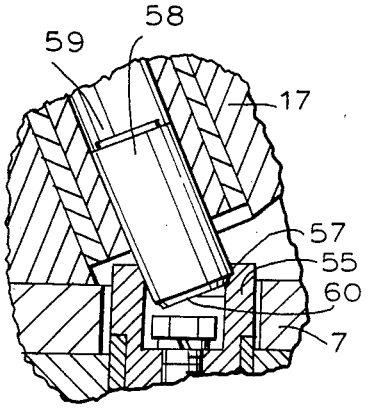
FIG. 4

DISC CRUSHER

BACKGROUND OF THE INVENTION

This invention relates to a disc crusher comprising a case with a disc seated in it, above which a cone is mounted inclined in a bearing housing so that the generatrix of the cone forms with the disc surface a crushing gap, the cone together with the bearing housing being secured by a device for axial displacement and shock-absorbing springs.

A known disc crusher is disclosed in German published patent application No. DE-OS 2 606 485 which consists of a case with a horizontally disposed disc having a vertical axis. On the top side of the disc there is provided an inclined cone, the generatrix of which forms with the disc surface a constant rectangular crushing gap. The point of intersection of the axes of the cone and the disc lies in the plane of the disc. The disc and the cone are driven by individual electric motors. For the removal of the crushed product, a hole is provided in the case behind the crushing gap so that the crushed material carried by the disc is thrown out through it. Onto the disc, close to the outlet hole in the case of the crusher, a scrape-off blade is rigidly mounted, which blade directs the crushed product towards the outlet hole.

The drawbacks of the known crusher are that it is necessary to release all the springs by unwinding of the compression nuts before setting up the crushing gap, and then to effect the setting up by means of other nuts, the number of which is twice that of the number of springs, and each one must be safeguarded against self unscrewing, and then again the springs must be compressed until the spring compression for operation is reached. Another drawback is the need for scrape-off blades which complicates the construction and the maintenance of the crusher. The blades break or wear out frequently and this requires their replacement. A further drawback lies in the connection between the cone and the disc which puts additional loads on the bearings.

SUMMARY OF THE INVENTION

It is therefore a general object of the present invention to avoid the aforementioned drawbacks by developing a disc crusher in which the crushing gap can be set-up quickly, accurately, and easily, even during operation, if necessary; to provide a simple and reliable design with centering of the working bodies one with respect to the other.

This object is achieved by disc crusher comprising a base frame on which a case with a cover is mounted, and in this case there is seated a bottom disc seated in a bearing housing fastened to the cover of the case by means of a flange with stud bolts and springs, while the bottom disc has a certral hole, and a conical disc has also a central hole. According to the invention, the flange of the bearing housing is connected by means of stud bolts and springs to a top ring with flange and a bottom ring with flange, also fastened by means of stud bolts to the cover of the case which have on their external surfaces formed threads with opposite direction and are embraced externally by a regulating sleeve (nut) on the internal cylindrical surface of which there are formed threaded zones which correspond to the threads of the top ring with flange and the bottom ring with flange, and the regulating sleeve is provided on the outside with a guiding disc connected to a driving mechanism and an arresting mechanism. In the bottom end of the bearing housing there is a key, which is in contact with the internal surface of the bottom ring with flange. In the central hole of the bottom disc there is provided a centering cone which is disposed with its front conical part in a central hole of the conical disc. At tight contact of the conical disc to the bottom disc their axes intersect at an angle [beta] at a distance "a" from the top surface of the bottom disc, and this distance is equal to 0.35 of the height "h" of the latter. The flange of the bottom ring has peripheral holes of elliptical shape.

The advantages of the disc crusher according to the invention lie in the ability to easily and quickly regulate the size of the crushing gap without disturbing the operation of the crusher. Because of this advantage, it is also possible to use a system for automatic checking and setting-up of the crushing gap and of the granulometric composition of the product, respectively. Another advantage lies in the reliable centering of the conical disc with respect to the bottom disc during operation and the setting-up of the position of both discs one with respect to the other.

For providing an additional regulable pressure, it is possible instead of springs to use hydropneumatic springs and hydraulic oil. The advantages of this variant lie in that the regulation of the spring compression is effected quickly and easily.

The joining surface of the flange of the bottom ring is fastened to the cover by means of stud bolts so that it is possible by means of the nuts of the stud bolts to lift or lower it or to incline it in a desired direction.

According to the invention, the cone can be centered with respect to the center of the disc in two ways: the first way is effected by means of a centering body which enters the central cylindrical hole of the cone and comes in contact with it in a point or a line while, at the same time, its base lies rigidly in a central hole of the disc; in the second way, a cup with a conical hole is rigidly mounted in the central hole of the disc, in which cup there enters with its one end an axle which comes in line with the conical surface, while the other end of the axle enters the cylindrical hole of the cone.

According to the invention, the bearing body of the cone is inclined transversely to the plane formed by the crushing gap and the axis of the shaft of the cone (the bearing body of the cone). It is thus possible to regulate the parallelism between the generatrix of the cone and the surface of the disc.

BRIEF DESCRIPTION OF THE DRAWING

With these and other objects in view, which will become apparent in the following detailed description, the present invention, which is shown by example only, will be clearly understood in connected with the accompanying drawing, in which:

FIG. 3 shows a cross-sectional view of the bearing housing of the cone above the flange of the bottom ring along the line B—B as shown in FIG. 1; and FIG. 4 is an enlarged view of the centering unit shown in FIG. 1.

DESCRIPTION OF THE PREFERRED EMBODIMENTS

Figure 1:
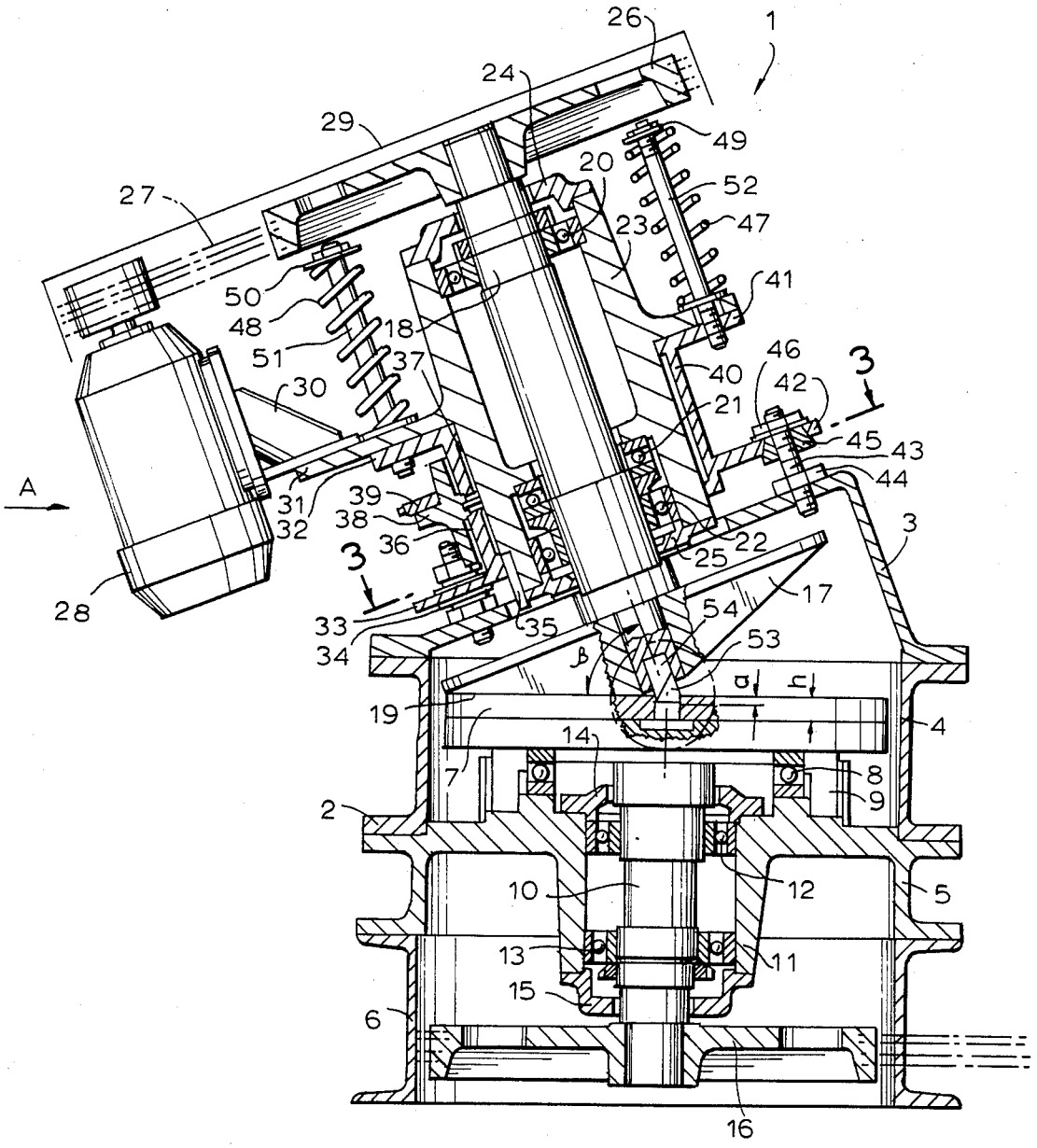
FIG. 1 shows a cross-sectional view of the disc crusher in a plane passing through the two axes of the shafts and the crushing gap.
Figure 2:
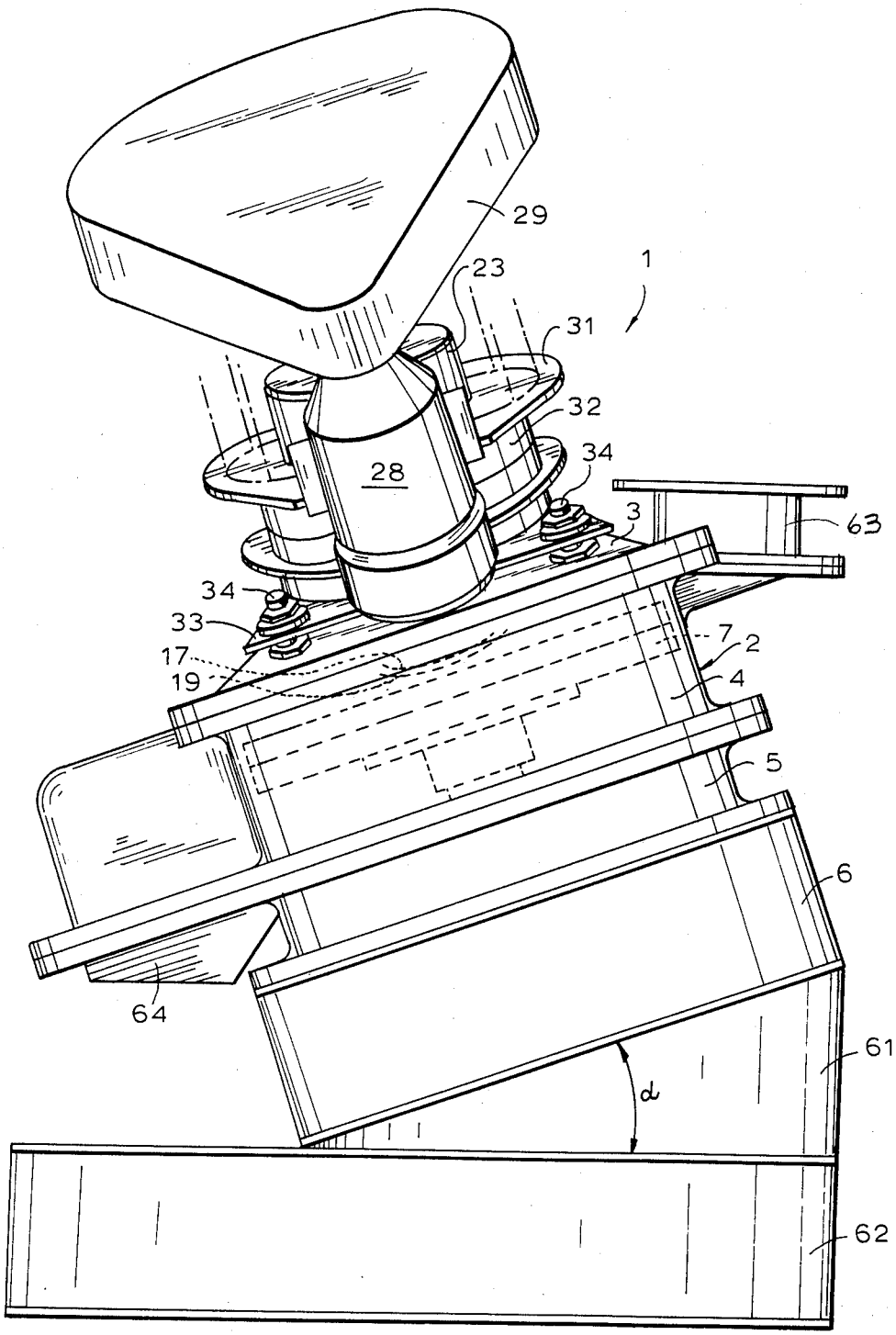
FIG. 2 shows a side view of the disc crusher from the side of the crushing gap in the direction "A" in FIG. 1.

Referring to FIGS. 1 and 2, the disc crusher 1 comprises a case 2, which is formed of a first cover 3, a central body 4 and a bottom 5. The latter lies on a base frame 6.

In the case 2 there is mounted a disc 7 which is seated on an axial bearing 8 which is laterally sealed by a first ring 9. The disc 7 is mounted on a first shaft 10 which is seated in the bottom 5 of the case 2. At the other end of the shaft 10 there is mounted a first belt pulley 16. The drive of the disc 7 is thereby effected by means of an electric motor which is not shown in the drawing.

Above the disc 7 there is disposed the cone 17 which is fastened to a second shaft 18. The axis of the shaft 18 and the generatrix of the cone 17 form an acute angle [beta] so that the generatrix of the cone 17 remains parallel to the surface of disc 7. Thus, there is formed the crushing gap 19 which remains constant in height during the process of crushing.

The shaft 18 of cone 17 is mounted on first, second and third anti-friction bearings 20, 21, 22 in a bearing body 23 which is closed on both sides with second and third covers 24 and 25. At the top end of shaft 18 there is mounted a second belt pulley 26 which is connected by means of v-belts 27 with the motor 28. A protective cover 29 protects the belt transmission 27. The electric motor 28 is mounted on a support 30 on flange 31, which is an integral part of the bearing body 23.

The fastening of flange 31, respectively the bearing body 23, to the first cover 3 is shown in FIG. 1 in two versions:

According to the first version, shown on the left, the bearing body 23 lies onto two rings (i.e. second and third ring 32, 33, to distinguish from first ring 9 mentioned above) the bottom or third ring 33 is mounted by means of its flange and stud bolts 34 to the cover 3. A key 35 provides for the axial displacement of the bearing body 23 with respect to the bottom ring 33. Both rings 32 and 33 are provided on their external surfaces with oppositely directed threads 36 and 37 and are embraced externally by a regulating sleeve 38 which has on its internal cylindrical surface zones with threads corresponding to the threads of rings 32, 33. On the flange of the regulating sleeve 38 there is mounted a guiding disc 39 connected to a driving mechanism and an arresting mechanism, which are not shown in the drawing. When the regulating sleeve 38 rotates in one or the other direction, the bearing body 23 together with the cone 17 are lifted or lowered, thus regulating the height of the crushing gap 19.

According to the second version, shown on the right, the bearing body 23 is fastened to the cover 3 by means of the joining body 40 having top and bottom flanges 41 and 42. The bottom flange 42 is fastened to the cover 3 by means of several stud bolts 43, only one of them being shown in the drawing. In this case the regulating of the height of the crushing gap is effected by means of all nuts 46 of the stud bolts 43.

On the flange 31 of the bearing body 23, there are arranged springs 47, 48 by means of stud bolts 51, 52, which pass freely through holes in flange 31 of the bearing body 23 and are fastened rigidly to the flange 32 or 41 of the top ring 32 or the joining body 40, respectively, depending on which embodiment is chosen, and arresting washers 49, 50. Thus, the spring pressure remains independent of the motion of cone 17 in its axial direction when the height of the crushing gap 19 is being set.

In the center of disc 7 there is provided a rigid centering body 53 which enters in the central cylindrical hole 54 of the cone 17.

FIG. 4 shows an alternate embodiment of the centering of cone 17 with respect to disc 7. Instead of the centering body 53, in this case there is used a cup 55, the top part of which is provided with a conical hole 57. In this conical hole 57 there is disposed with its bottom end an axle 58, the top end of which is disposed in the cylindrical hole 59 of cone 17. By means of a chamfer 60, the axle 58 is in contact on both sides with the conical hole 57 and fixes the cone 17 on both sides in a radial direction.

In FIG. 2, which shows the disc crusher form the side, there is seen the frame 6, which lies by means of the wedge-shaped joint 61 on the horizontal frame 62. Thus the disc crusher is inclined in the direction of the inlet hole 63 towards the outlet hole 64 at an angle [alpha] which can be from 0°–90°. Thus, the disc 7 is inclined, and the crushing gap, lying in the plane formed by both shafts 10 and 18 (FIG. 1), is also inclined.

FIG. 3 is a cross-sectional view through the bearing body 23. The bottom (third) ring 33 with its flange, resembling in shape a triangle, is rigidly connected by means of three stud bolts 34 to the cover 3 (FIGS. 1 and 2) of the disc crusher. FIG. 3 shows the first version of fastening the bearing body 23, which is also shown as left part of FIG. 1. By means of the nuts of the stud bolts 34 the bearing body 23 an be inclined in the direction of the crushing gap 19, the point of rotation being the centering body 53. Thus, a rectangular shape of the crushing gap is ensured. For this purpose the holes 65, 66, and 67 in ring 33, shown in FIG. 3 are elliptical.

Although the invention is described and illustrated with reference to a plurality of embodiments thereof, it is to be expressly understood that it is in no way limited to the disclosure of such preferred embodiments but is capable of numerous modifications within the scope of the appended claims.

I claim:

1. A disc crusher comprising a case with a cover in which a disc having a top surface is seated, and a first shaft mounted in a bearing body and disposed at an angle with respect to the disc surface, on which shaft there is mounted a cone, the generatrix of the cone being parallel to the top surface of the disc, while the bearing body together with the shaft and the cone is displaceable axially forming thus a crushing gap between the generatrix of the cone and the top surface of the disc, the bearing body being provided with a flange, on which flange there are arranged a plurality of shock absorbing springs; and a joining body having upper and lower flanges, the flange of the bearing body being joined to the upper flange of the joining body, by means of stud bolts passing freely through holes in the flange of the bearing body, the upper flange, and said springs, and said joining body being joined by means of its lower flange to the cover of the case;

said joining body comprising a top ring with said upper flange and a bottom ring with said lower flange, said top and bottom rings being provided on their external surfaces with threads, the threads of the top ring being pitched opposite to the threads of the bottom ring so that the axial displacement of the bearing body, the shaft and the cone which forms the crushing gap is effected twice as fast as were said threads not oppositely pitched.

2. A disc crusher according to claim 1 further comprising said bottom ring having an internal surface with a key groove, and said top and bottom rings being embraced externally by a threaded regulating sleeve, said sleeve being provided on its internal surface with threaded zones corresponding to the threads of the top and bottom rings, and said sleeve being provided with an external guiding disc, and a key in the bottom end of the bearing body, said key being in contact with the key groove in the internal surface of the bottom ring.

3. A disc crusher according to claim 1, wherein arresting washers are attached to the stud bolts and bias said springs.

4. A disc crusher according to claim 1, wherein the stud bolts together with the springs form a protective shock absorber which circularly embraces the bearing body.

5. A disc crusher according to claim 1, wherein said cone has a peak, and the peak of the cone and the center of the disc are connected by means of a centering body.

6. A disc crusher according to claim 5, wherein the centering body is mounted in a central hole of the disc and enters a cylindrical hole of the cone.

7. A disc crusher according to claim 5, wherein the centering body is shaped as a cylinder which is disposed in a central hole of the cone, the disc is provided with a central hole which is conical in shape, and the bottom end of the centering body is in contact line with the conical surface of the central hole of the disc.

8. A disc crusher according to claim 1, wherein the bearing body is laterally movable with respect to the surface formed by the crushing gap and the shaft.

9. A disc crusher according to claim 1, wherein the top surface of top disc is inclined at an angle of from 0° to 90°.

* * * * *